United States Patent [19]

Mikasa et al.

[11] 4,027,965

[45] June 7, 1977

[54] COPYING MACHINE CONTROL MECHANISM

[75] Inventors: Yoshio Mikasa; Masami Nakane, both of Toyokawa; Yukio Tokura, Toyohashi, all of Japan

[73] Assignee: Minolta Camera Kabushiki Kaisha, Osaka, Japan

[22] Filed: Apr. 28, 1975

[21] Appl. No.: 572,294

[30] Foreign Application Priority Data

May 15, 1974 Japan ..... 49-55815[U]
May 31, 1974 Japan ..... 49-62271

[52] U.S. Cl. ..... 355/13; 83/205; 355/14

[51] Int. Cl.[2] ..... G03G 15/00

[58] Field of Search ..... 355/3 R, 8, 13, 14; 83/203, 205, 209, 221, 245

[56] References Cited

UNITED STATES PATENTS

| | | | |
|---|---|---|---|
| 3,399,610 | 9/1968 | Eichorn | 355/14 X |
| 3,637,305 | 1/1972 | Tanaka et al. | 355/13 |
| 3,651,727 | 3/1972 | Suzuki et al. | 355/13 X |
| 3,672,762 | 6/1972 | Suzuki et al. | 355/8 X |
| 3,700,327 | 10/1972 | Murgas et al. | 355/14 |
| 3,797,931 | 3/1974 | Miciukiewicz et al. | 355/13 |

*Primary Examiner*—Fred L. Braun
*Attorney, Agent, or Firm*—Wenderoth, Lind & Ponack

[57] ABSTRACT

A control mechanism for use in a photoelectrostatic copying machine utilizing a roll of recording medium as a source of material on which an image of the original to be copied is reproduced, which control mechanism controls the sequence of operation of various operating elements of the copying machine. The control mechanism for this purpose utilizes a rotatable cam assembly which, during rotation thereof through first and second predetermined angles, actuates first and second microswitches, respectively, which are electrically coupled to the feeder mechanism, illumination device and electrostatic charger and the drive unit for moving a transparent support structure for support of the original to be copied thereon. A third microswitch electrically coupled to the cutter unit may be actuated by either the cam assembly or an operating member adjustably carried by either of the transparent support structure and illumination device.

9 Claims, 10 Drawing Figures

FIG. 5 (II)

COPYING MACHINE CONTROL MECHANISM

The present invention relates to a photoelectrostatic copying machine utilizing a roll of recording medium, for example, recording paper, as a source of material on which an image of the original to be copied is reproduced and, more particularly, to a control mechanism in the photoelectrostatic copying machine for controlling the sequence of operation of various operating elements of the copying machine.

Various electrostatic copying machines are known wherein a roll of recording paper is replaceably provided as a source of recording medium on which an image of the original is to be reproduced. These copying machines can be classified into two types depending upon the mode of cutting of recording paper from the roll. One type of copying machine utilizes a so-called "step cut" mode, wherein the rolled paper is successively cut into sheets of predetermined size, for example, A-5 size, B-4 size or B-5 size which are respectively defined as having a length of 210 mm., 257 mm. and 182 mm. according to the Japanese Industrial Standards, and the other type of copying machine utilizes a so-called "random cut" mode, wherein the rolled paper is successively cut into sheets of desired size.

In the copying machine of any type referred to above, a cutting mechanism is necessarily employed and control of the cutting mechanism in relation to control of sequential operation of the other operating elements, such as an electrostatic charger, an illumination device and the others, is carried out by the use of an electrical signal.

By way of example, the copying machine employs at least two microswitches disposed in spaced relation to each other in the vicinity of or on the path of travel of recording paper for respectively detecting passage of leading and trailing ends of the recording paper therethrough and subsequently generating electrical signals which are in turn utilized to control the sequence of operation of the operating elements, including the cutter mechanism, of the copying machine.

However, it has been found that, since the actuator of any of the microswitches projects therefrom into the path of travel of the recording paper within the copying machine, it often constitutes a cause of jamming of paper within the copying machine. Moreover, parts associated with the microswitches, expensive electrical parts, such as microswitches, solenoids and others, are necessitated which leads to increase of the manufacturing cost of the copying machine.

In addition, since the sequence of operation of the electrostatic charger, illumination device, cutting mechanism and other operating elements of the copying machine is controlled by the use of microswitches, relays and other electrical parts, deviation in responsibility of any of the electrical parts employed is liable to disturb the sequence of operation thereof.

Accordingly, an essential object of the present invention is to provide a control mechanism for a photoelectrostatic copying machine of the type referred to above, which substantially eliminates the use of such expensive electrical parts as heretofore employed for coordinating various movable mechanical parts of the copying machine.

Another important object of the present invention is to provide a control mechanism which is made of mechanical parts and assures the timed sequence of operation of the various operating elements of the copying machine.

A further object of the present invention is to provide a control mechanism which can be manufactured by the use of inexpensive mechanical parts and, therefore, contributes to substantial reduction of the manufacturing cost of the copying machine as well as the electrical power consumption of the copying machine.

These and other objects and features of the present invention will become apparent from the following description taken in conjunction with preferred embodiments thereof with reference to the accompanying drawings, in which:

FIG. 5(II) illustrates the synchronizing mechanism in the other operational position;

Before the description of the present invention proceeds, it should be noted that, for the sake of brevity, like parts are designated by like reference numerals throughout the accompanying drawings.

Figure 1:
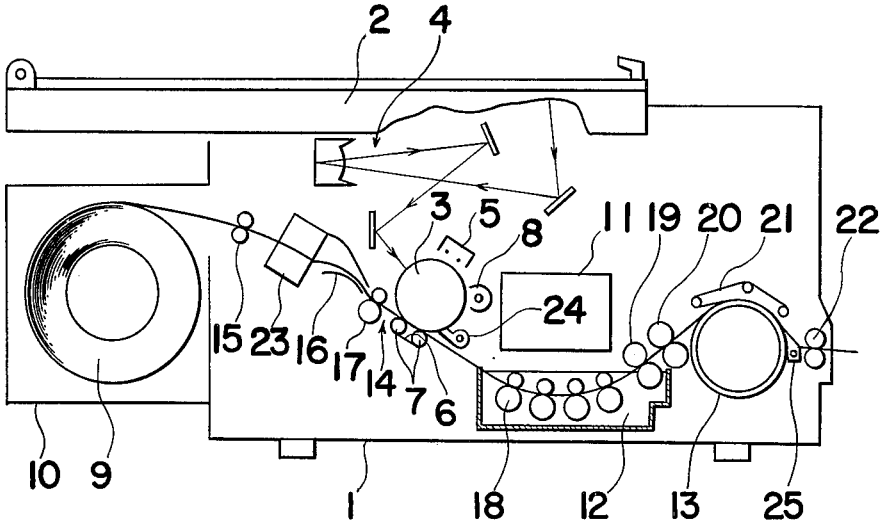
FIG. 1 is a schematic side sectional view of a copying machine to which the present invention is applied.

Referring first to FIG. 1, there is schematically illustrated a photoelectrostatic copying machine utilizing a known wet developing process, to which the present invention is advantageously applicable. The copying machine to which the present invention is applicable may be of any known construction and, accordingly, for the sake of brevity, the construction of the illustated copying machine will be described in terms of its function.

The copying machine shown in FIG. 1 comprises a housing structure 1 accommodating therein a photoreceptor drum 3 having the outer periphery formed as a photoreceptor surface. The photoreceptor drum 3 is supported in position within the housing structure 1 for rotation past a charging station at which a uniform electrostatic charge is placed by an electrostatic charger 5 on the photoreceptor surface of said photoreceptor drum 3; an imaging or exposure station at which a flowing optical image of the original to be copied, which original is placed on a transparent support table 2, is projected through an optical system 4 onto the photoreceptor surface of said photoreceptor drum 3 to produce an electrostatic latent image on said photoreceptor surface; a transfer station at which the electrostatic latent image is transferred onto a web of recording medium, for example, paper, being moved in contact with the photoreceptor surface of the photoreceptor drum 3 and backed up by an endless belt 6 operatively suspended between a pair of spaced rolls 7; and an erasing station at which residual electrostatic charge is erased by an erasing lamp 8 in readiness for the next cycle of the copying operation.

The web of paper to which the electrostatic latent image has been transferred from the photoreceptor surface of the photoreceptor drum 3 at the transfer station is, after having been separated by a separating blade 24 from the photoreceptor surface of the drum 3, drawn into a developing bath 12 by a plurality of pairs of juxtaposed drawing rolls 18 operatively immersed in a developing liquid within the developing bath 12. The web of paper, which has passed through the developing station at which the development is completed and a visual image is obtained, is subsequently fed towards a fixing station through a pair of juxtaposed squeezing rolls 19 and then a pair of juxtaposed liquid absorbing rolls 20. At the fixing station, while the web of paper is sandwiched between a heat applying roll 13 and an endless back-up belt 21, heat is applied to the web of paper not only for fixing the developed image on the paper, but also for drying the same paper. Thereafter, the complete web of paper with the image fixed thereon is drawn out of the housing structure 1 by means of a pair of juxtaposed ejecting rolls 22 after having been separated from the outer peripheral surface of the heat applying roll 13 by a separating blade 25.

Positioned above the developing bath 12 is a liquid tank 11 for accommodation of developing liquid to be supplied into said bath 12 in any known manner.

The web of paper referred to above originates from a roll of paper 9, housed in a cassette 10 detachably connectable to the housing structure 1 with the leading end of the rolled paper 9 held in position ready to enter the housing structure 1. The web of paper from the roll 9 is fed towards the transfer station of the photoreceptor drum 3 by a paper feed mechanism 14 which includes a pair of juxtaposed feed rolls 15, a cutter unit 23, an elongated paper guide 16 and a pair of intermediate feed rolls 17, all arranged in the order given above. However, it should be noted that the various pairs of rolls 15, 17, 18, 19, 20 and 22 and related parts define a passage through which the web of paper is transported from the roll 9 to the outside of the housing structure 1.

Although not shown, the housing structure 1 has a control console mounted on the top of the housing structure and clear of the path of travel of the transparent support structure 2. As will become clear from the subsequent description of the present invention, the control console accommodates various representations and operating elements which are respectively available and accessible to the operator of the copying machine.

The control mechanism according to one preferred embodiment of the present invention is shown in FIGS. 2 to 6.

With particular reference to FIGS. 2 to 5, most operating elements of the control mechanism according to the present invention are housed in the control console at a position preferably adjacent the path of travel of the transparent support structure 2 for support thereon of the original to be copied. The control mechanism comprises a control cam assembly 26 including first, second and third cam discs **26*a*, 26*b* and 26*c* all supported on a sleeve 27 in spaced relation to each other and for rotation together with said sleeve 27. The sleeve 27 carrying the control cam assembly 26 as hereinbefore described is mounted on a shaft 35 for rotation about and independent of said shaft 35, which shaft is in turn coupled to a drive gear 37, coupled to a drive unit (not shown), for example, an electric motor, through an intermediate transmission gear 36 via a driven gear 38 rigidly mounted on said shaft 35. Between one of the control cam discs, which is the closest to the driven gear 38 on the shaft 35, and said driven gear 38 is positioned a friction disc 39 which may be integrally formed with said driven gear 38. The friction disc 39 is normally in contact with the control cam assembly 26 and, therefore, the cam disc 26*c*, which is biased together with the driven gear 38 by a spring washer 40 coaxial with said shaft 35, so that the control cam assembly 26 and, therefore, the sleeve 27 together with the cam discs 26*a* to 26*c*, can be rotated counterclockwise, as viewed in FIG. 3, by the rotational force of the driven gear 38 which is transmitted thereto through said friction disc 39**.

Figure 3:
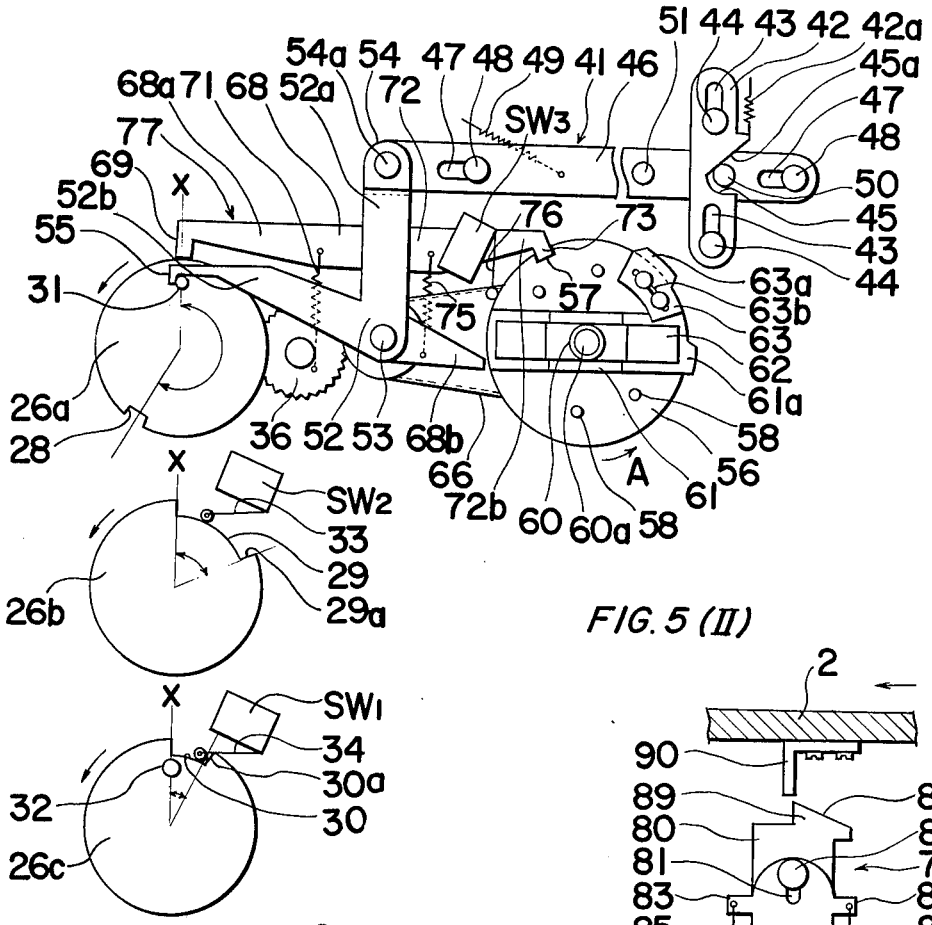
FIG. 3 is a front elevational view of the control mechanism shown in FIG. 2.
Figure 3:
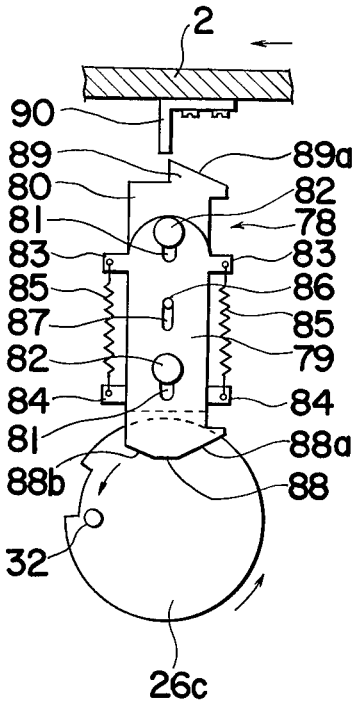

As best shown in FIG. 3, the first cam disc **26*a* has formed in its peripheral surface a detent recess 28 spaced an angular distance of 212° in the clockwise direction from a detent pin 31 secured to said cam disc 26*a*. The second cam disc 26*b* also has formed in its peripheral surface a cut-out portion 29, which angularly extends 61° and which is positioned so that an actuator 33 of a microswitch SW2 can be operated to turn the microswitch SW2 on when the actuator 33 slides over a set-up portion 29*a* and after the cam assembly 26 has rotated an angular distance of 61° from a start position indicated by X. Similarly, the third cam disc 26*c* also has formed in its peripheral surface a cut-out portion 30, which angularly extends 15° and which is positioned so that an actuator 34 of a microswitch SW1 can be operated to turn the microswitch SW1 on when the actuator 34 slides over a set-up portion 30*a* and after the cam assembly 26** has rotated an angular distance of 15° from the start position X.

The first microswitch SW1 is electrically coupled to a feeder clutch (not shown), operatively associated with the paper feed mechanism 23 so as to operate the latter when said feeder clutch is engaged, an illumination lamp (not shown) positioned immediately below the transparent support structure 2 for illumination of the original to be copied as said support structure 2 is moved above said lamp together with said original to be copied, and the electrostatic charger 5 while the second microswitch SW2 is electrically coupled to a scan clutch (not shown) which, when engaged, causes the transparent support structure 2 to start its movement.

The control mechanism includes a mechanical signal generator generally indicated by 41. The mechanical signal generator 41 comprises an operating lever 42 supported in position for movement between inoperative and operative positions by means of set pins 44 extending through respective slots 43 which, in cooperation with said set pin 44, define the distance between the inoperative and operative positions of said operating lever. The operating lever is, however, normally biased to said inoperative position by a spring element 42*a*, for example, a tension spring and is adapted to be moved against said spring element 42*a* to said operative position when the operator of the copying machine depresses a start button (not shown) mounted on, or otherwise linked to, said operating lever 42. Operatively associated with said operating lever 42 is a connecting lever 46 supported in position for movement between rest and operated positions by means of set pins 48 extending through respective slots 47 which, in cooperation with said set pins 48, define the distance between the rest and operated positions of said connecting lever 46. The connecting lever 46 is, however, normally biased to said rest position by a spring element 49, for example, a tension spring, and is adapted to be moved against said spring element 49 to said operated position in response to movement of the operating lever 42 towards said operated position. It is to be noted that, so long as the connecting lever 46 is held in the rest position, an engagement pin 50 rigidly carried by the connecting lever 46 and extending therefrom in a direction perpendicular to the plane of said lever 46 is engaged in a detent notch 45 formed in the operating lever 42.

The mechanical signal generator 41 further comprises a locking lever 52 of substantially V- or L-shaped configuration having one end 52*a* pivotally connected to an adjacent end of the connecting lever 46 by a connecting pin 54*a* through a bridge member 54, which bridge member 54 merely serves as a connecting member and may be integrally formed with either said connecting lever 46 or said locking lever 52, said locking lever 52 being pivotally supported in position at a substantilly intermediate portion thereof by a shaft member 53. The other end 52*b* of said locking lever 52 has formed thereon, or is otherwise formed into, a hook 55 engageable with a stop 31, carried by the cam disc 26*a* at a position 212° spaced from the detent recess 28 in said cam disc 26*a* in the clockwise direction, so that rotation of the cam assembly 26 can be restricted even though said cam assembly 26 receives the rotational force transmitted thereto from the driven gear 38 through the friction disc 39 and, therefore, tends to rotate together with said sleeve 27.

The mechanical signal generator 41 so far described operates in the following manner. Assuming that the start button (not shown) disposed on the control console and connected to the operating lever 42 is manually depressed by the operator to cause the operating lever 42 to move from the inoperative position to the operative position against the spring element 42*a* while the drive gear 37 is rotated, the engagement pin 50 on the connecting lever 46 relatively slides over an inclined ridge 45*a* which defines the detent notch 45 in the operating lever 42, thereby causing the connecting lever 46 to move from the rest position to the operated position against the action of spring element 49. As the connecting lever 46 moves in the manner as hereinbefore described, the locking lever 52 pivots clockwise about the shaft member 53 with the hook 55 on the end 52*b* of said locking lever 52 disengaging from the stop 31 on the cam disc 26*a* whereby the control cam assembly 26 can be rotated counterclockwise about the shaft 35 by the rotational force transmitted thereto through the friction disc 39.

Accordingly, it is clear that the mechanical signal generator 41 acts to apply a mechanical signal indicative of depression of the start button which is effected when the copying operation is to be initiated, to the control cam assembly 26 to cause the latter to be rotated by the rotational force transmitted thereto from the driven gear 38 through the friction disc 39. So long as the mechanical signal is not applied to the control cam assembly 26 and the hook 55 is, hence, engaged with the stop 31 on the cam disc 26*a*, slip takes place between the friction disc 39 and the cam disc 26*a* so that the control cam assembly 26 will not be rotated.

Figure 2:
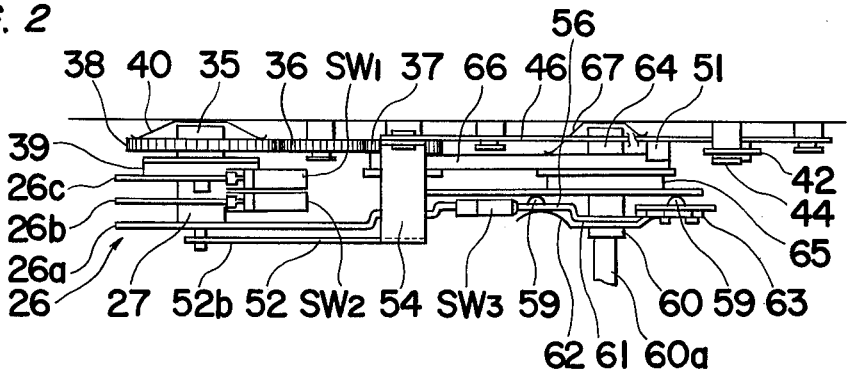
FIG. 2 is a top plan view, on an enlarged scale, of a control mechanism employed in the copying machine according to one preferred embodiment of the present invention.

A stepwise cutting governing cam 56 is rotatably mounted on a shaft 60 and has formed in one surface detent holes or recesses 58, the respective positions of said detent recesses 58 corresponding to different standard sizes of recording paper, for example, A-4, B-4 and B-5 sizes. Cooperative with said detent recesses 58 on said stepwise cutting governing cam 56 are, as best shown in FIG. 2, detent balls 59 carried by an index plate 61 which is rigidly mounted on the shaft 60 for rotation together with said shaft 60 and which is biased rearwardly by a leaf spring 62 disposed on the shaft 60 between said index plate 61 and a wall portion of the control console. The index plate 61 carries an operating member 63 having at least one elongated, curved slot 63*b* through which at least two set screws are treaded in spaced relation to each other. It should be noted that, by undoing the set screws used to secure the operating member 63 to said index plate 61, the position of the operating member 63 relative to the actuator 76 of a microswitch SW3, which is positioned on the path of angular travel of said operating member 63, can be adjusted in the direction of the circumference of the governing cam 56.

The shaft 60 has a reduced diameter portion 60*a* coaxial therewith, which reduced diameter portion 60*a* rotatably extends through the wall portion of the control console and in turn has mounted thereon a size selection dial (not shown) bearing such representations as A-4, B-4 and B-5 at positions corresponding to the respective positions of the detent holes 58 in the governing cam 56. It will be seen that, by manually turning the size selection dial, the index plate 61 together with the operating member 63 can be rotated relative to the governing cam 56.

The shaft 60 is in the form of a sleeve and is mounted on a rigid shaft 64 for rotation independent of said rigid shaft 64 and in coaxial relation to said rigid shaft 64, which shaft 64 has mounted thereon a sprocket wheel (not shown) and a friction disc 65. The shaft 64 is operatively associated with the drive gear 37 by means of an endless belt 66 suspended between said sprocket wheel (not shown) on said shaft 64 and another sprocket wheel (not shown) coaxial and rotatable together with said drive gear 37. However, a spring washer 67 is loosely mounted on the shaft 64 and presses the sprocket wheel (not shown) on said shaft 64 towards said governing cam 56 with the friction disc 65 held in position to transmit the rotational force of the sprocket wheel on said shaft 64 to said cam 56 whereby the index plate 61 can be rotated counterclockwise together with said governing cam 56.

The microswitch SW3, which is normally opened and is disposed in the vicinity of the peripheral surface of the governing cam 56, is electrically connected to an actuating solenoid (not shown) associated with the cutter unti 23. This microswitch SW3 can be turned on, or closed, when the actuator 76 thereof is retracted in contact with a projection 63*a* of the operating member, which outwardly projects from the level of the peripheral surface of said governing cam 56, during rotation of the governing cam 56 in the counterclockwise direction as viewed in FIG. 3.

Figure 4:
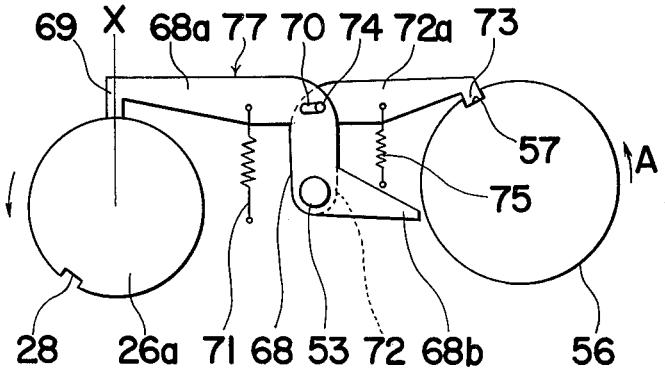
FIG. 4 is a schematic diagram showing a mechanical association between a control cam assembly and a governing cam, employed in the control mechanism shown in FIGS. 2 and 3.

The control cam assembly 26 of the construction as hereinbefore described is operatively associated with the governing cam 56 by means of a linkage mechanism best shown in FIG. 4 and generally indicated by 77.

The linkage mechanism 77 comprises first and second pivotal levers 68 and 72 of substantially L-shaped configuration having mutually adjacent ends pivotally mounted on the shaft member 53. As shown in FIG. 4, the other end portions 68*a* and 72*a* of the respective first and second pivotal levers 68 and 72 extend in the opposite directions with respect to each other.

The first pivotal lever 68 has a feeler 69 formed thereon adjacent the end portion 68*a*, which feeler 69 is held in sliding contact with the peripheral surface of the cam disc 26*a* for selective engagement into and disengagement from the detent recess 28 by means of a spring element 71 arranged so as to bias the first pivotal lever 68 in a counterclockwise direction about the shaft 53. It will consequently readily be seen that, upon counterclockwise rotation of the cam assembly 26 through an angle of 212° from the start position X where the hook 55 has been engaged with the stop 31 on the cam disc 26*a*, the feeler 69 on the first pivotal lever 68 will be trapped the detent recess 28 thereby to hold the cam assembly 26 in a stopped position until the feeler 69 is subsequently disengaged from said detent recess 28 in such a manner as will be described later.

The first pivotable lever 68 also has a tail 68*b* integrally formed therewith adjacent the shaft member 53 and extending in a direction opposite to the end portion 68*a* and substantially parallel to the end portion 72*a* of the second pivotable lever 72, the tip of which tail 68*b* is located on the path of travel of a projection 61*a* of the index plate 61. Accordingly, it will readily be seen that, upon engagement of the projection 61*a* of the index plate 61, being rotated together with the governing cam 56, with the tip of the tail 68*b* on said first pivotal lever 68, the latter can be pivoted clockwise against the spring element 71 about the shaft 53 with the feeler 69 consequently disengaged from the detent recess 28 if the cam assembly 26 has been held in the stopped position.

The first pivotal lever 68 also has therein a slot 70, the function of which will be described later.

The second pivotal lever 72 has a feeler 73 formed thereon adjacent the end portion 72*a*, which feeler 73 is held in sliding contact with the peripheral surface of the governing cam 56 for selective engagement into and disengagement from a detent recess 57, formed in said cam 56, by means of a spring element 75 arranged so as to bias the second pivotal lever 72 in a clockwise direction about the shaft 53. It is to be noted that the spring elements 71 and 75 may be tension springs as shown, in which case the tension spring 71 should have a pulling force greater than that of the tension spring 75.

The second pivotal lever 72 is rigidly provided as at 74 with a pin member which extends through the slot 70 formed in the first pivotal lever 68. The slot 70 is so sized that, if the feeler 73 is engaged in the detent recess 57 in the governing cam 56, engagement of the feeler 69 on the first pivotal lever 68 and, therefore, the pivotal movement of the first pivotal lever 68 in the counterclockwise direction, which is effected in the manner as hereinbefore described, causes the second pivotal lever 72 to pivot in the counterclockwise direction against the spring element 75 about the shaft 53 with the feeler 73 disengaging from said detent recess 57.

Figure 5I:
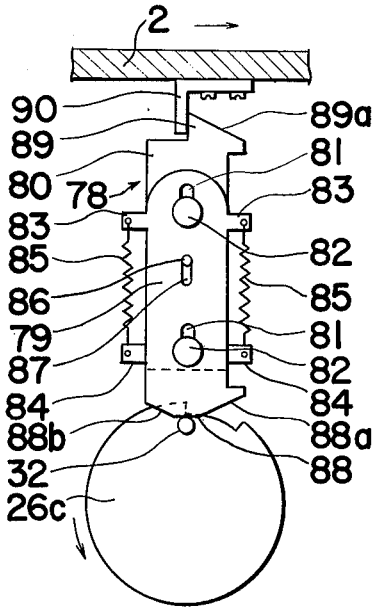
FIG. 5(I) illustrates a synchronizing mechanism employed in the control mechanism, said synchronizing mechanism being illustrated as occupying one operational position.
Figure 6:
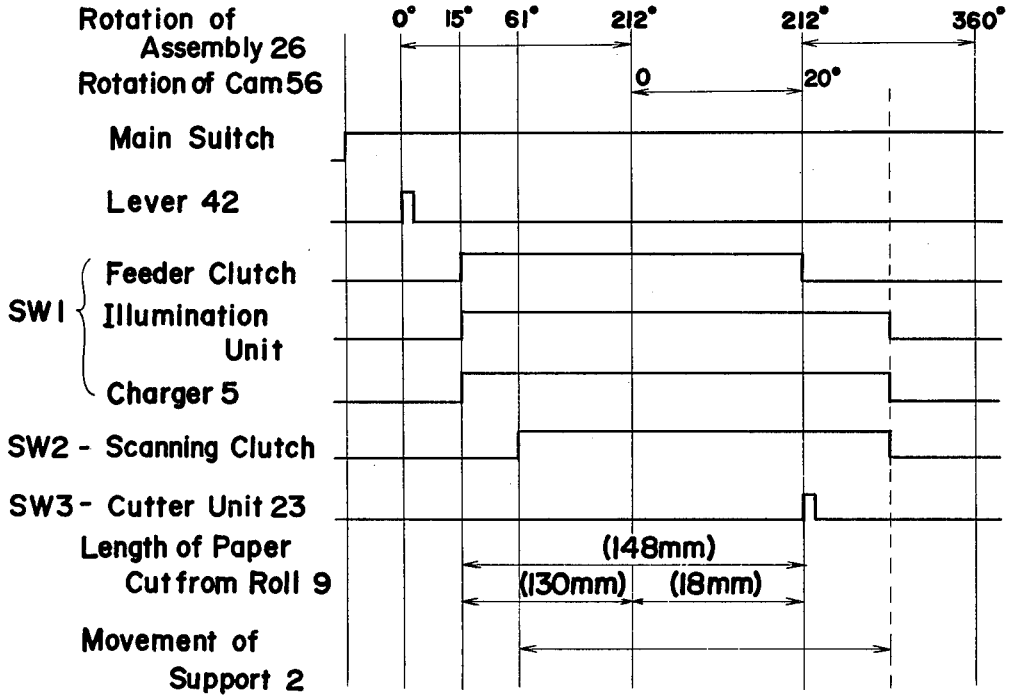
FIG. 6 is a time chart showing the sequence of operation of various operating elements of the copying machine in relation to rotation of the control cam assembly and the governing cam employed in the control mechanism.

FIGS. 5(I) and (II) illustrate a synchronizing mechansim 78 for synchronizing the start of movement of the transparent support structure 2 for support of the original to be copied with rotation of the control cam assembly 26. The synchronizing mechanism 78 comprises a slidable plate 79 and a stopper plate 80, both supported in position below the transparent support structure 2 for vertical relative movement by means of a least two common set pins or screws 82 which extend through respective slots 81, formed in said plates 79 and 80, and threaded into a wall member of, or a framework for, the housing structure 1. Coiled springs 85 are respectively suspended between lugs 83 and 84 of associated pairs of lugs, which lugs 83 and 84 are respectively formed on the plates 79 and 80 and extend therefrom in the opposite directions to each other and at right angles to the lengthwise direction of said plates 79 and 80, so that said plates 79 and 80 can be biased in the opposite directions away from each other. For restricting the relative movement between the slidable plate 79 and the stopper plate 80, the stopper plate 80 is provided at a substantially intermediate portion thereof with an engagement pin 86 which loosely extends through a slot 87 formed in a corresponding portion of the slidable plate 79. The combination of the engagement pin 86 and the slot 87 may not be necessary if the slots 81 formed in both of the plates 79 and 80 are adequately sized.

The slidable plate 79 has a lower end portion slightly outwardly rounded to provide an abutment 88 and a pair of opposed inclined ridges 88*a* and 88*b* on respective sides of said abutment 88. So long as the cam assembly 26 is not rotated, the slidable plate 79 is upwardly shifted with said abutment 88 resting on a stop 32, secured to one surface of the cam disc 26*c* substantially in alignment with the stop 31 on the cam disc 26*a*. Since the coiled springs 85 act to pull the lugs 83 and 84 close to each other and, therefore, to separate the plates 79 and 80 from each other, upward shift of the slidable plate 79 with the abutment 88 resting on the stop 32 carried by the cam disc 26*c* accompanies a corresponding upward shift of the stopper plate 80. Accordingly, so long as the cam assembly 26 is not rotated and, hence, the start button coupled to the operating lever 42 has not yet been depressed, an engagement 89 formed on the uppermost end of the stopper plate 80 engages a stop 90, secured to the undersurface of the movable transparent support structure 2, thereby holding the transparent support structure 2 in a start position, substantially as shown in FIG. 5(I).

Disengagement of the engagement 89 from the stop 90 carries by the transparent support structure 2 takes place as the cam assembly 26 commences to rotate about the shaft 35. More particularly, as the cam disc 26*c* is rotated counterclockwise with the stop 32 relatively sliding on the inclined ridge 88*b*, the slidable plate 79 is downwardly shifted with consequent downward shift of the stopper plate 80. Therefore, the downward shift of the stopper plate 80 results in the disengagement of the engagement 89 from the stop 90, thereby permitting the transparent support structure 2 to be moved from the start position to a scanned position so that the original to be copied, which is placed on said transparent support structure 2, can relatively be scanned by the optical system 4.

When the transparent support structure 2 which has been moved to the scanned position returns to the start position, the stop 90 carried thereby slides over an inclined ridge 89*a*, formed on the stopper plate 80 adjacent the engagement 89, causing the stopper plate 80 to be downwardly shifted against the coiled springs 85 substantially as shown in FIG. 5(II). Accordingly, even if the cam assembly 26 completes its rotation through an angle of 360° with the stop 32 on the disc 26*c* returned again to the original, start position X thereby upwardly shifting the slidable plate 89, the transparent support structure 2 can completely be returned to the original, start position without being disturbed by the engagement 89 on the stopper plate 80 then upwardly biased.

While constructed in the manner as hereinbefore described, the control mechanism according to the present invention functions as follows. However, for facilitating better understanding of the operation of the control mechanism which will be described with reference to a time chart shown in FIG. 6, it is assumed that the size selection dial is set to an A-5 size position which means that the original to be copied is desired to be copied on a web of paper of 148 mm. in length. It is to be noted that, according to the Japanese Industrial Standards, A-5, B-4 and B-5 papers are defined as having respective lengths of 148 mm., 257 mm. and 182 mm.

Prior to initial depression of the start button, the operating elements of the control mechanisms assume respective positions as shown in FIG. 3. In other words, the control cam assembly 26 assumes the start position X while the rotation thereof is restricted by the hook 55 on the locking lever 52 engaged with the stop 31 on the cam disc 26*a*, and the feeler 73 on the second pivotal lever 72 of the linkage mechanism 77 is engaged in the recess 57 in the governing cam 56 thereby preventing the latter from rotating.

After the original to be copied is placed on the transparent support structure 2 and a main switch (not shown) inserted in an electric circuit for the drive unit (not shown) is turned on, prior to or subsequent to placement of the original on the support structure 2, to cause the drive gear 37 to rotate, the rotational force exerted by the drive gear 37 is transmitted to the friction disc 39 through the intermediate transmission gear 36 and then the driven gear 38 coaxial with said friction disc 39 and also to the friction disc 65 through the endless belt 66. As hereinbefore described, even though the friction discs 39 and 65 respectively pressed towards the cam discs 26*a* and the governing cam 56 receive the rotational force of the drive gear 37, they merely rotate in frictional engagement with and relative to the cam assembly 26 and the governing cam 56.

Subsequent depression of the start button (not shown) causes the operating lever 42 to move from the inoperative position to the operative position against the spring element 42*a*, and the locking lever 52 is pivoted clockwise, in the manner as hereinbefore described, with the hook 55 disengaging from the stop 31 on the cam disc 26*a* thereby permitting the cntrol cam assembly 26 to rotate counterclockwise accompanied by the rotation of the friction disc 39.

Upon rotation of the cam assembly 26 through an angle of 15°, the microswitch SW1 is turned on in the manner as hereinbefore described, whereby the feeder clutch (not shown), the illumination lamp (not shown) forming a part of the optical system 4, and the electrostatic charger 5 are all brought into operation. It is to be noted that when the feeder clutch is brought into operation, that is, engaged, supply of a web of paper from the roll 9 can be initiated through the feed passage extending within the housing structure 1.

Upon subsequent rotation of the control cam assembly 26 through an angle of 61° from the start position, the microswitch SW2 is turned on to energize the scanning clutch, operatively associated with the transparent support drive mechanism (not shown), so as to operate the latter thereby permitting the transparent support structure 2 to start its movement from the start position towards the scanned position. At this time, since the cam assembly 26 has already rotated from the start position, both the slidable plate 79 and the stopper plate 80 are downwardly shifted a distance defined by the length of each of the slots 81 and, therefore, the engagement 89 on the stopper plate 80 is positioned clear of the path of travel of the stop 90 carried by the transparent support structure 2.

The mechanical signal generator 41 can return to the original position when the operator of the copying machine ceases to apply a finger pressure to the start button, by the action of the individual spring elements 42*a* and 49.

When the cam assembly 26 completes rotation through an angle of 212° from the original position X, the feeler 69 is engaged in the detent recess 28 in the cam disc 26*a* thereby restricting further rotation of the cam assembly 26. Synchronously with said engagement of said feeler 69 in said detent recess 28, the feeler 73 on the second pivotal lever 72 is disengaged from the detent recess 57 in the governing cam 56 in the manner as hereinbefore described, thereby permitting the governing cam 56 before described, thereby permitting the governing cam 56 to be rotated by the friction disc 65 biased against said governing cam 56 by the spring washer 67 as to transmit the rotational force of the drive gear 37 thereto through the endless belt 66.

It is to be noted that the feeder clutch which, when engaged, actuates the paper feed mechanism, is still engaged so that supply of a web of paper from the roll 9 is continued. The rotation of the cam assembly 26 through an angle corresponding to the time interval between the time at which the microswitch SW1 is turned on to the time at which the feeler 69 engages in the detent recess 28, that is, the rotation of the cam assembly 26 through an angle of 212° less 15°, corresponds to feed of the paper web having a length of 130 mm., that is, 18 mm. short of the predetermined length for the A-5 size paper. The rest of the paper web, which is 18 mm. in length, can be fed through the paper feed passage within the machine housing structure 1 during subsequent rotation of the governing cam 56 which will now be described.

As the governing cam 56 together with the index plate 61 carrying the operating member 63 rotates counterclockwise as viewed in FIG. 3, the microswitch SW3 is subsequently turned on with the actuator 76 thereof retracted in contact with the operating member 63. The angle of rotation of the governing cam 56 from the time at which the feeler 73 disengages from the detent recess 57 to the time at which the operating member 63, carried by the governing cam 56 is rotated, causes the actuator 76 to be retracted from contact therewith is determined by the setting of the size selection dial and, therefore, the position of the index plate 61 relative to the governing cam 56. However, since in the description of the operation of the control mechanism the size selection dial has been assumed to be set to the A-5 size position while the rotation of the cam assembly 26 through an angle of 197° (212° less 15°) permits the feed of the paper web having a length of 130 mm. irrespective of the setting of the paper size selection dial, the angular distance between the projection 63*a* of the operating member 63 and the detent recess 57 corresponds to feed of the rest of the paper web. This can clearly be understood from the chart of FIG. 6 because, when the microswitch SW3 is turned on in the manner as hereinbefore described, the cutter clutch (not shown) is engaged to actuate the cutter unit 23. Accordingly, the length of the paper web cut from the roll 9 by the cutter unit 23 is 148 mm. which is the predetermined length for the A-5 size paper.

Further rotation of the governing cam 56 results in engagement of the projection 61*a* of the index plate 61 with the tail 68*b* on the first pivotal lever 68, thereby causing the latter to pivot clockwise about the shaft 53. Upon pivotal movement of the first pivotal lever 68 in the clockwise direction, the feeler 69, which has been engaged in the detent recess 28 in the cam disc 26*a*, disengages from said detent recess 28 whereby the cam assembly 26 can again be rotated by the rotational force of the drive gear 37 transmitted thereto through the friction disc 39. It is to be noted that, synchronously with disengagement of the feeler 69 from the detent recess 28, the feeler 73 on the second pivotal lever 72 is, in the manner as hereinbefore described, brought into contact with the peripheral surface of the governing cam 56 in readiness for subsequent engagement in the detent recess 57.

Upon completion of one complete rotation of the cam assembly 26, the actuators 34 and 33 of the microswitches SW1 and SW2 slide down into the cut-out portions 30 and 29, respectively, so that the microswitches SW1 and SW2 are turned off and, therefore, the feeder clutch, the illumination lamp, the electrostatic charger 5 and the scanning clutch for the transparent support structure 2 are all brought into inoperative condition. Particularly, when the scanning clutch is brought into the inoperative condition, that is, disengaged, the transparent support structure 2 which has been moved to the scanned position is permitted to return to the original, start position by the action of any suitable biasing means, such as a tension spring arrangement, which acts to pull the transparent support structure 2 towards the start position.

At the same time, the hook 55 in the locking lever 52 is brought in position to engage the stop 31 to maintain the cam assembly 26 in the start position X.

Subsequently, the governing cam 56 completes its 360° rotation. Upon completion of one complete rotation of the governing cam 56, the feeler 73 on the second pivotal lever 72 is again brought into engagement with the detent recess 57 in the governing cam 56 to stop the latter.

Thus, the various operating elements of the control mechanism according to the present invention return to the respective original positions as shown in FIG. 3, completing one cycle of the copying operation, in readiness for the next cycle of copying operation.

The control mechanism according to the foregoing embodiment of the present invention is designed so that a web of paper from the roll 9 can be cut in a predetermined length according to the setting of the size selection dial, that is, the position of the index plate 61 relative to the governing cam 56. By way of example, where the original to be copied is desired to be copied on a B-4 size paper, the angular distance between the detent recess 73 and the projection 63*a* of the operating member 63 will be set to be greater than that when the size selection dial is set to the A-5 size position and, in practice, corresponds to the feed of the paper web having a length of 127 mm., that is, 257 mm. (the predetermined length for the B-4 size paper) less 130 mm. (the length of paper fed during 197° (212° less 15° ) rotation of the cam assembly 26).

Figure 8:
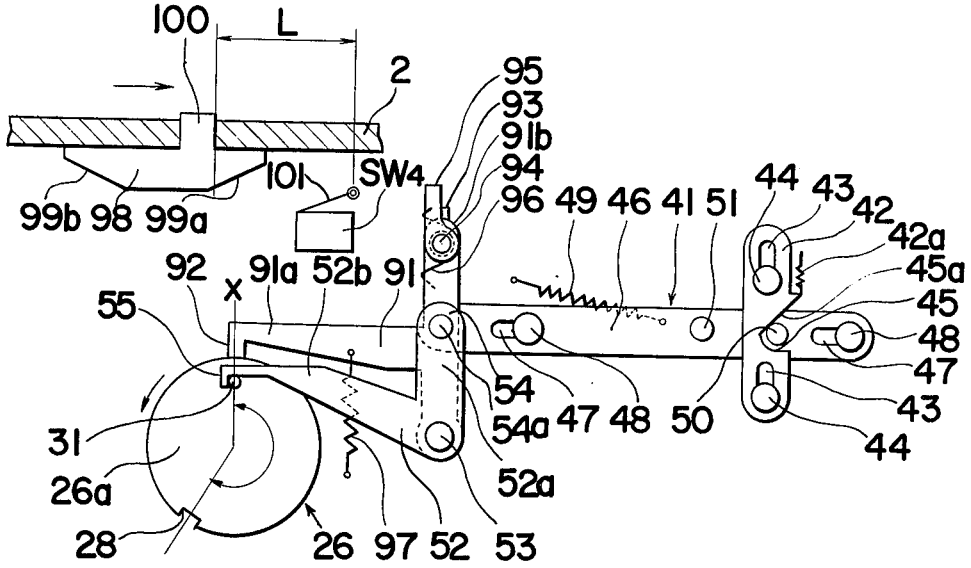
FIG. 8 is a front elevational view of the control mechanism according to the second preferred embodiment of the present invention.

In the embodiment shown in FIG. 8, the control mechanism is designed so that a web of paper from the roll 9 can be cut in a desired length irrespective of the length of the original to be copied.

Referring now to FIG. 8, the control mechanism shown comprises the control cam assembly 26, the mechanical signal generator 41, all being identical with that employed in the foregoing embodiment of FIGS. 2 to 5, a linkage lever 91 and a size setting member 98.

The linkage lever 91 is pivotally mounted on the shaft 53 and is biased counterclockwise about the shaft 53 by a spring element 97, for example, a tension spring. This linkage lever 91 has one end portion 91*a* extending towards the control cam assembly 26 and terminating in a feeler 92 integrally formed therewith, the function of said feeler 92 corresponding to that of the feeler 69 employed in the foregoing embodiment. The linkage lever 91 has an arm 91*b* integrally formed therewith and extending substantially at right angles to the end portion 91*a* thereof and in a direction towards the undersurface of the transparent support structure 2. At a portion of the arm 91*b* adjacent the tip thereof, the arm 91*b* carries an escapement lever 95 pivotally mounted thereon by means of a fitting pin 94, which escapement lever 95 is normally biased clockwise about the pin 94 by a wire spring 96 having one end engaged with said escapement lever 95 and the other end engaged with a portion of the arm 91*b* adjacent the junction between the end portion 91*a* and said arm 91*b*, a substantially intermediate, coiled portion of said wire spring 96 being mounted on the fitting pin 94. Clockwise rotation of the escapement lever 95 is so restricted by a stop 93, integrally formed with said arm 91*b*, that the escapement lever 95 stands upwards in a direction parallel to the lengthwise direction of the arm 91*b*.

The size setting member 98 is slidably carried by the transparent support structure 2 for movement in a direction parallel to the direction of movement of said support structure 2. This size setting member 98 has a handle portion 100, which extends through an elongated guide slot (not shown), formed in a frame member of the transparent support structure 2 in a direction parallel to the direction of movement of said support structure 2, and terminates above the upper surface of said transparent support structure 2. The size setting member 98 has a pair of opposed inclined faces formed at 99*a* and 99*b*, the function of each of which will be described later.

Fixedly positioned below the path of travel of the size setting member 98 which moves together with the movement of the transparent support structure 2 is a microswitch SW4 electrically coupled to the cutter clutch associated with the cutter unit 23, which microswitch SW4 has an actuator 101 retractable when contacted by the size setting member 98 to turn the microswitch SW4 on.

More specifically, as the size setting member 98 moves in the direction indicated by the arrow together with the movement of the transparent support structure 2, the actuator 101 of the microswitch SW4 slides along the inclined face 99*a* on the size setting member 98 so that said actuator 101 is retracted to switch the microswitch SW4 on. Further movement of the size setting member 98 together with the transparent support structure 2 results in engagement of the size setting member 98 against the escapement lever 95 so that the linkage lever 91 is pivoted clockwise about the shaft 53 with the feeler 92 disengaging from the detent recess 28 in the disc cam 26*a* if said feeler 92 has been engaged in said detent recess 28.

Figure 7:
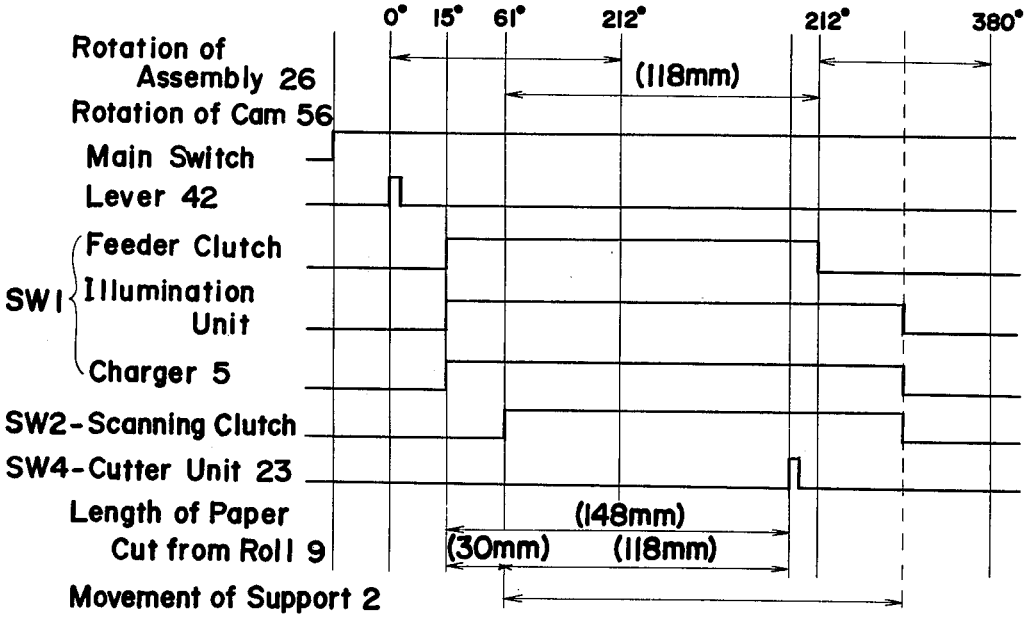
FIG. 7 is a time chart similar to that shown in FIG. 6, but related to the control mechanism according to a second preferred embodiment of the present invention.

The operation of the control mechanism according to the embodiment shown in FIG. 8 will subsequently be described with particular reference to the time chart of FIG. 7.

Prior to or subsequent to placement of the original to be copied on the transparent support structure 2 in such a manner that one end of the original is engaged with the leading end of the transparent support structure 2 with respect to the direction of movement thereof towards the scanned position, the size setting member 98 is manually adjusted to a desired position spaced from the actuator 101 of the microswitch SW4 a distance L corresponding to the desired length of the web of paper to be cut from the roll 9. The position of the size setting member 98 may be in line with the other end of the original placed on the transparent support structure 2 if the length of the paper web to be cut from the roll 9 is desired to correspond to the entire length of the original to be copied.

Assuming that the various operating elements of the control mechanism shown in FIG. 8 are respectively positioned as shown in FIG. 8, the main switch in the electric circuit for the drive unit is subsequently turned on to cause the drive gear 37 to rotate. Alternatively, the main switch referred to above may be switched on prior to or subsequent to the placement of the original on the support structure 2 or prior to or subsequent to setting of the size setting member 98 in the manner as hereinbefore described.

When the mechanical signal generator 41 is operated in the same manner as in the foregoing embodiment of FIGS. 2 to 5, the hook 55 on the locking lever 52 disengages from the stop 31 on the disc 26*a*, thereby permitting the cam assembly 26 to receive the rotational force of the drive gear 37 through the friction disc 39 in the same way as in the foregoing embodiment.

As the control cam assembly 26 rotates counterclockwise, the microswitches SW1 and SW2 are successively turned on to bring the feed clutch, the illumination lamp, the electrostatic charger 5 and the scanning clutch into operation in the same manner as in the foregoing embodiment. However, at the time the cam assembly 26 completes its rotation through an angle of 212° from the start position X, the feeler 92 on the linkage lever 91 is engaged in the detent recess 28 in the cam disc 26*c*, causing the linkage lever 91 to pivot counterclockwise about the shaft 53 and also causing the cam assembly 23 to stop while the friction disc 39 continues to rotate in frictional engagement with to the cam assembly 26.

Since the transparent support structure 2 has already been moved towards the scanned position upon engagement, or operation, of the scanning clutch which is effected by the switch-on of the microswitch SW2, further movement of the transparent support structure 2 towards the scanned position results in engagement of the size setting member 98 with the actuator 101 of the microswitch SW4 so that the cutter clutch associated with the cutter unit 23 is engaged to actuate said cutter unit 23. Substantially at the same time, the size setting member 98, then moving together with the transparent support structure 2 being moved towards the scanned position, abuts against the escapement lever 95, pivoting the linkage lever 91 clockwise about the shaft 53.

Upon pivotal movement of the linkage lever 91 in the clockwise direction caused by abutment of the size setting member 98 against the escapement lever 95, the feeler 92 on said linkage lever 91 disengages from the detent recess 28 in the cam disc 26*a*, permitting the control cam assembly 26 to again rotate until it completes 360° rotation.

Upon completion of the 360° rotation of the cam assembly 26, the microswitches SW1 and SW2 are, in the same way as in the foregoing embodiment, turned off so that the feed clutch, the illumination lamp, the electrostatic charger 5 and the scanning clutch are all brought into inoperative condition. Simultaneously therewith, the stop 31 on the cam disc 26*a* is trapped by the hook 55 on the locking lever 52 to halt the next cycle of rotation of the control cam assembly 26.

The size member 98, carried by the transparent support structure 2, may be moved past the escapement lever 95 when the transparent support structure 2 arrives at the scanned position. Even if this occurs, return movement of the transparent support structure 2 will not be disturbed by the escapement lever 95 since, during the return movement of the transparent support structure 2 towards the start position, the size setting member 98 causes the escapement lever 95 to pivot counterclockwise agains the wire spring 96 about the fitting pin 94.

It is to be noted that the distance L between the set position of the size setting member 98 and the actuator 101 of the microswitch SW4 is not equal to the length of the paper web desired to be cut from the roll 9. More specifically, during a period from the time at which the microswitch SW1 is turned on to the time at which the microswitch SW2 is turned on to operate the scanning clutch, that is, during rotation of the cam assembly 26 through an angle of 61° less 15°, a certain length of the paper web has already been transferred towards the photoreceptor drum 3 which is less the desired length. By way of example, in the case where the original to be copied is to be copied on a paper of 148 mm. in length and, accordingly, the handle portion 100 of the size setting member 98 is set to an appropriate position spaced a distance L from the leading end of the transparent support structure 2 with respect to the direction of movement thereof towards the scanned position, a paper web having a length of 30 mm. will be fed during the rotation of the cam assembly through the angle of 46° (61° less 15° ). The rest, that is, 118 mm., of the paper web can be fed during a period between the time at which the scanning clutch is operated and the time at which the size setting member 98, which has been moved together with the transparent support structure 2 arriving at the scanned position, turns the microswitch SW4 on to actuate the cutter unit 23 through the cutter clutch.

The control mechanism according to any of the foregoing embodiments shown in FIGS. 2 to 5 and FIG. 8, respectively, can have a repeat mechanism incorporated therein for enabling automatic repetition of copying operation without requiring repeated depression of the start button. The employment of the repeat mechanism is advantageous where the only and the same original is desired to be copied on a plurality of recording papers.

Figure 9:
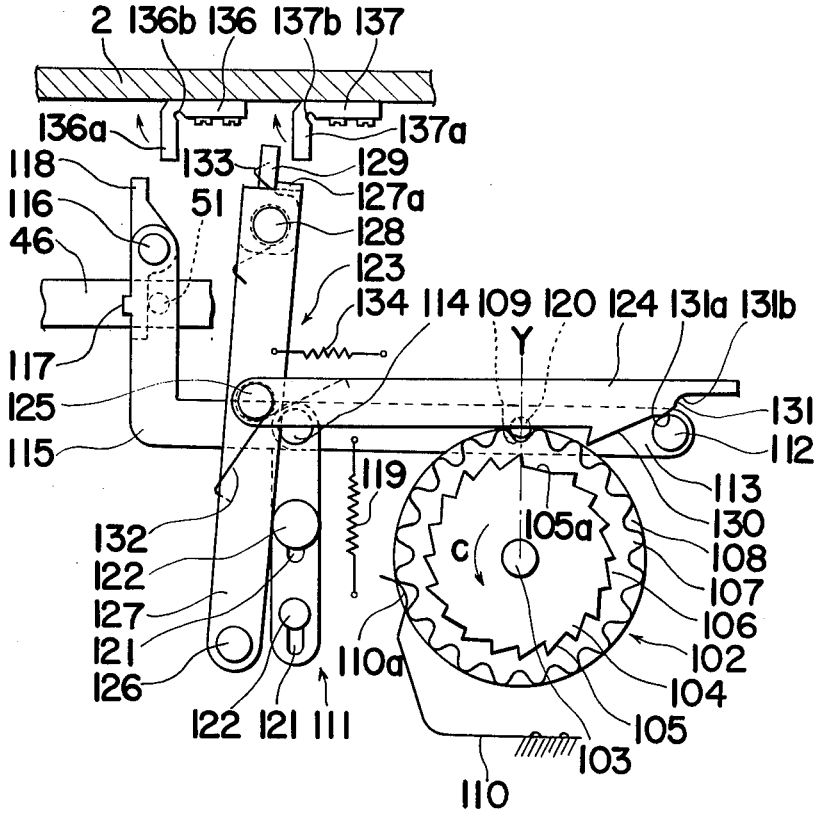
FIG. 9 is a front elevational view of a repeat mechanism which may be utilized in any of the embodiments respectively shown in FIGS. 2 to 5 and FIG. 8.

The repeat mechanism referred to above is illustrated in FIG. 9. As stated above, this repeat mechanism shown in FIG. 9 can be applicable to either of the foregoing embodiments of FIGS. 2 to 5 and FIG. 8.

Referring now to FIG. 9, the repeat mechanism comprises a counter wheel assembly 102 having a toothed escape wheel 104, a toothed indexing wheel 106 and an operating disc 108, all formed integrally with each other and mounted on an operating shaft 103 for rotation together therewith. The escape wheel 104 has a peripheral surface having as at 105*a* a toothless portion, the remaining portion of said peripheral surface of said wheel 104 having a plurality of equally spaced ratchet teeth 105 which are oriented so that said escape wheel 104 and, therefore, the counter wheel assembly 102, can be rotated stepwise counterclockwise about the shaft 103 each time an escapement 130 being moved is engaged into a groove between an adjacent pair of the ratchet teeth 105. The indexing wheel 106 has a peripheral surface having a plurality of round-topped teeth 107 circumferentially spaced from each other a distance or pitch equal to the pitch between adjacent pair of the ratchet teeth 105 on the escape wheel 104. The operating disc 108 has a peripheral surface having a radially inwardly extending recess 109 positioned in register with one of the ratchet teeth 105 which is located at the leading side of the toothless portion 105*a* with respect to the direction of rotation of the counter wheel assembly 102 indicated by the arrow C. It should be noted that, so long as the control mechanism is not operated, the counter wheel assembly 102 is positioned such that the recess 109 in the operating disc 108 assumes a start position as indicated by Y.

Fixedly positioned in the vicinity of the counter wheel assembly 102 and resiliently engaged with the indexing wheel 106 is a leaf spring 110 having one end secured to a suitable framework of the housing structure 1 and the other end selectively resiliently engageable in any of the tooth grooves in the indexing wheel 106 for regulating stepwise rotation of the indexing wheel 106 and, therefore, the counter wheel assembly 102.

Although not shown, the shaft 103 has one end terminating outside the housing structure and, particularly, the control console, and in turn has mounted thereon a counter dial which has an exterior surface provided, or otherwise engraved or embossed, with a series of numerical characters arranged circumferentially about the shaft 103, which numerical characters are cooperative with a pointer, provided on the control console in the vicinity of the circumference of the counter dial, to show the number of copying operations repeated or the number of recording papers desired.

The counter wheel assembly 102 is operatively associated with the mechanical signal generator 41 by means of an actuating mechanism 111 which will now be described.

The actuating mechanism comprises a pivotable support lever 113 having one end pivotally supported in position by means of a shaft 112, a pivotable actuating lever 115 having a substantially intermediate portion pivotally connected to the other end of said support lever 113 by a connecting pin 114, and an engaging member 118 pivotally mounted on one end of said actuating lever 115 by a mounting pin 116 and held in position so as to extend upwardly by a stop 117 integrally formed on said lever 115 for restricting clockwise rotation of said engaging member 118.

The pivotable support lever 113 carries a roller 120 and is normally biased counterclockwise about the shaft 112 by a spring element 119, for example, a tension spring, with said roller 120 engaged in the recess 109 in the operating disc 108 so long as the counter wheel assembly 102 is in the start position Y.

In the arrangement so far described, if the counter dial is manually rotated in the direction C to set a desired number of repetitions of the copying operation, the roller 120 on the support lever 113 is forced to disengage from the recess 109 during corresponding rotation of the counter wheel assembly 102, so that the support lever 113 is pivoted clockwise against the spring element 119.

The actuating lever 115 is supported for movement toward and away from the transparent support structure 2 by a pair of mounting pins 122 extending through slots 121 formed on the other end portion of said actuating lever 115. Since the actuating lever 115 is pivotally coupled to the support lever 113 by means of the connecting pin 114, it is clear that pivotal movement of the support lever 113 about the shaft 112 accompanies corresponding movement of the actuating lever 115 toward and away from the transparent support structure 2. It is, however, to be noted that, when the actuating lever 115 is moved toward the transparent support structure 2 in response to clockwise rotation of the support lever 113 against the spring element 119, one end of the engaging member 118 pivotally carried by said actuating lever 115 is brought in position ready to engage an operating piece 136 secured to the undersurface of the transparent support structure 2 as will be described in more detail hereinafter. The other end of the engaging member 118, which substantially overlaps the end portion of the actuating lever 115, is situated between the stop 117 and a pin member 51 carried by the connecting lever 46 which has already been described in connection with the embodiments of FIGS. 2 to 5 and FIG. 8. As will be described in more detail hereinafter, assuming that the actuating lever 115 is moved toward the transparent support structure 2 in the manner as hereinbefore described, engagement of the operating piece 136, then moving together with the movement of the transparent support structure 2 from the scanned position to the start position, with the adjacent end of the engaging member 118 results in pivotal movement of said engaging member counterclockwise about the mounting pin 116 with said other end of said member 118 moving the connecting lever 46 towards the operated position in contact with the pin 51 on said connecting lever 46.

The repeat mechanism further comprises a transfer mechanism 123 for stepwisely rotating the counter wheel assembly 102 in response to repetition of copying operation to cause the counter dial to return to a zero position. This transfer mechanism 123 comprises a pivotable lever 127 having one end pivotally connected in position by a mounting pin 126, an escapement lever 124 having one end pivotally connected by a connecting pin 125 to a substantially intermediate portion of said pivotable lever 127, a substantially intermediate portion of said escapement lever 124 extending above the counter wheel assembly 102, and an engaging member 129 pivotally mounted on the other end of said pivotable lever 127 by means of a mounting pin 128 and normally biased clockwise about said pin 128 by a wire spring 133 until it abuts against a stop 127*a* integrally formed on said pivotable lever 127.

Adjacent the other end of the escapement lever 124, the escapement lever 124 has thereon a pawl 130, selectively engageable with any of the ratchet teeth 105 on the escape wheel 104, and a slide edge 131 having a projection 131*a* and a rounded recess 131*b*. The pivotable lever 127 is biased clockwise about the pin 126 by a spring element 134, for example, a tension sprng, and, on the other hand, the escapement lever 124 is biased clockwise about the pin 125 by a wire spring 132, having both ends respectively engaged with said pivotable lever 127 and said escapement lever 124, a substantially intermediate, coiled portion of said wire spring 132 being mounted on said pin 125, so that, so long as the repeat mechanism is not operated, said projection 131*a* rests on the shaft 112 while the pawl 130 is held in position away from the ratchet teeth 105.

It is to be noted that, for the reason which will become apparent from the subsequent description, the force of the wire spring 133 biasing the engaging member 129 is selected so as to be greater than the pulling force of the spring element 134 so that engagement of an operating piece 137, secured to the undersurface of the transparent support structure 2, with the engaging member 129 during movement of the transparent support structure 2 from the scanned position towards the start position will not result in pivotal movement of said engaging member 129 against the wire spring 133, but pivotal movement of the pivotable lever 127 against the spring element 134.

The operating pieces 136 and 137 may be of the same construction, preferably made of synthetic resin, for example, polypropylene, and are bent to provide downwardly extending lugs 136*a*and 137*a*, respectively. It is to be noted that, in each of the operating pieces 136 and 137, a line of weakness, for example, a cut line 136*b* or 137*b*, is formed at the bend thereof whereby, when said lug 136*a* or *a* abuts against the engaging member 118 or 129 during the movement of the transparent support structure 2 from the scanned position to the start position, it causes the engaging member 118 or the pivotable lever 127 to pivot counterclockwise about the pin 116 or 126 and, during the movement from the start position to the scanned position, the lug 136*a* or 137*a* outwardly pivots about the cut line 136*b* or 137*b* when it comes in contact with the engaging member 118 or 129 to let the engaging member 118 or 129 pass below said operating piece 136 or 137.

The wire spring 133 used to bias the engaging member 129 against the stop 127*a* acts to release an excessive load which may otherwise be imposed on the engaging member 127 by the operating piece 137 when the transparent support structure 2 erroneously functions.

The repeat mechanism of the construction as hereinbefore fully described functions as follows. Before the description of the operation of the repeat mechanism proceeds, it is assumed that the counter dial is positioned such as to be in a "20 " position which means that the original to be copied is desired to be copied on twenty sheets of recording paper.

As the counter dial is manually rotated to set it to the 20 position with the counter wheel assembly 102 rotating. counterclockwise about the shaft 103, the roller 120 on the support lever 113 escapes from the recess 109 in the operating disc 108, rolling on the peripheral surface of said operating disc 108. Upon escapement of the roller 120 from the recess 109, the support lever 113 is pivoted clockwise about the shaft 112 and, consequently, the actuating lever 127 is moved upwardly toward the transparent support structure 2 with the engaging member 118 being brought into the path of travel of the operating piece 136.

Thereafter, the start button is depressed to initiate a copying operation of the copying machine in the manner as hereinbefore described in connection with the foregoing embodiments of FIGS. 2 to 5 and FIG. 8. It is to be noted that, although depression of the start button causes the connecting lever 46 to move towards the operated position against the spring element 49, the pin 51 carried thereby merely separates from the lower end of the member 118 carried by the actuating lever 115.

At the time the control cam assembly 26 has been rotated through an angle of 61°to switch the microswitch SW2 on in the manner as hereinbefore described, the transparent support structure 2 commences to move from the start position towards the scanned position. During the travel of the transparent support structure 2 from the start position towards the scanned position, the engaging members 118 and 129 cause the lugs 136*a* and 137*a* of the respective operating pieces 136 and 137 carried by the transparent support structure 2 to outwardly pivot about the cut lines 136*b* and 137*b* without disturbing the continued movement of the transparent support structure 2 towards the scanned position.

After the control cam assembly 26 completes one rotation thereby completing one cycle of the copying operation, and shortly before or upon return of the transparent support structure 2 to the start position, the lugs 136*a* and 137*a* of the operating pieces 136 and 137 abut against the engaging members 118 and 129, respectively, at the same time or at different times.

Upon abutment of the lug 137*a* against the engaging member 129, the pivotable lever 127 is pivoted counterclockwise about the pin 126 against the spring element 134 and the escapement lever 124 moves to the left as viewed from FIG. 9. Consequently, the projection 131*a* on the escapement lever 124 slides down the peripheral surface of the shaft 112 which then engages in the recess 131*b* and the pawl 130 engaging into one of the tooth grooves of the escape wheel 104 shifts the escape wheel 104 and, therefore, the counter wheel assembly 102 a distance corresponding to one pitch between the adjacent pair of the teeth 105. Stepwise rotation of the counter wheel assembly 102 accompanies corresponding rotation of the shaft 103 and, therefore, the counter dial also rotates to show a reading of "19" which means that the first one of the 20 copies has been reproduced.

On the other hand, upon abutment of the lug 136*a* against the engaging member 118, the latter pivots counterclockwise about the pin 116 and, therefore, the connecting lever 46 is again moved towards the operated position with the pin 51 in contact with the lower end of said engaging member 118, thereby initiating the next cycle of the copying operation without the start button required to be depressed.

In the manner as hereinbefore described, the copying operation is repeated until the pointer on the control console is at the zero position of the counter dial.

When the pointer is at the zero position of the counter dial, the counter wheel assembly 102 has been returned to the original, start position X in which condition the roller 120 on the actuating lever 115 becomes again engaged in the recess 109 in the operating disc 109.

Consequently, upon engagement of the roller 120 in the recess 109, the actuating lever 115 pivots counterclockwise about the shaft 112 being biased by the spring element 119 with the engaging member 118 retracting from the path of travel of the operating piece 136. It is to be noted that the various operating elements of the repeat mechanism return to the respective original positions as shown in FIG. 9 when the operating pieces 136 and 137 are moved past the engaging members 118 and 129 with the transparent support structure 2 arriving at the start position.

The main switch inserted in the electric circuit for the drive unit which, when operated, drives the drive gear 37 may be made to be turned off in response to engagement of the roller 120 in the recess 109.

Although the present invention has been fully described in conjunction with the preferred embodiments thereof with reference to the accompanying drawings, it should be noted that various changes and modifications are apparent to those skilled in the art. By way of example, where the copying machine to which the present invention is desired to be applied is of a type having a movably supported illumination lamp and a stationarily held transparent support structure, some or all of the elements which have been described as carried by the transparent support structure 2 in the foregoing embodiments may be carried by the movably supported illumination lamp. Moreover, although the control cam assembly 26 has been described as composed of the three different cam discs 26*a*, 26*b* and 26*c*, they may be integrally formed with each other in a single disc member.

The synchronizing mechanism 78 may not be always necessary depending upon the type of system by which the transparent support structure 2 is reciprocated between the start position and the scanned position.

Furthermore, although the present invention has been described by way of example as applied to the photoelectrostatic copying machine utilizing the wet developing process, it should be understood that the present invention can equally be applicable to any photoelectrostatic copying machine utilizing a dry developing process wherein toner particles are applied over the photoreceptor surface at the developing station to form a powdered image in the configuration of the original to be copied. The photoreceptor surface may comprises a portion of an endless belt or a portion of the photoreceptor drum such as hereinbefore described.

Accordingly, such changes and modifications are to be understood as included within the scope of the present invention unless they depart therefrom.

What is claimed is:

1. In an electrophotographic copying apparatus including a reciprocatingly movable support onto which an original to be copied is placed, a scanning means for driving said support and including a clutch for controlling the drive of said scanning means, a stationary optical system having an illuminating means for projecting an image of the original, a feeding means for feeding a copying paper from a roll along a predetermined path, a feeding clutch coupled to said feeding means, and a cutting means disposed on said path for cutting the copying paper; a control means which comprises:

a movable member on said support for aligning with one end of the original placed on said support and having a projecting member integral therewith, a cutting switch connected to said cutting means and positioned in the path of said projecting member for being actuated thereby as said support is moved, a manually actuated copy initiating means having an arm extending therefrom, a first cam having an engaging portion normally engaged by said arm for preventing said first cam from rotating, said first cam initiating its rotation upon operation of said copy initiating means, a second cam coaxial with and rotatable together with said first cam for actuating said feeding clutch for feeding the copying paper in substantial synchronism with the initiation of rotation of said first cam, a third cam for actuating said clutch of said scanning means for moving said support in delayed relation to the initiation of the rotation of said first cam, said projecting member and said cutting switch being spaced a distance such that when said support is moved said switch is actuated for cutting the copying paper into a length substantially corresponding to the length fed during the rotation of said first cam from the initiation of the rotation until the energization of said clutch by said scanning means by said third cam plus the length fed during the movement of said projecting member until the actuation of said switch thereby.

2. A control means as claimed in claim 1 in which said first cam has a further engaging portion thereon spaced around the periphery thereof from said first engaging portion, a lever having one end biased toward said first cam and engageable in said further engaging portion, the other end of said lever being in the path of said movable member for engagement by said movable member after said movable member has actuated said cutting switch, whereby the movement of said cams is arrested after said further engaging means is engaged by said lever and is not resumed until after the actuation of said cutting switch.

3. In an electrophotographic copying apparatus including a support onto which an original to be copied is placed, an optical system having an illuminating means for projecting an image of the original, a feeding means for feeding a copying paper from a roll of paper along a predetermined path, said feeding means being operatively associated with a feeding clutch, and cutting means disposed along said path for cutting the copying paper;

a control means which comprises:

manually actuated copy initiating means;

a first cam means including at least first and second engaging portions, and a drive means operatively connected to said first cam means for rotating said first cam means;

said copy initiating means including an arm member having a locking portion normally engaging said second engaging portion for preventing said first cam means from being rotated and which locking portion is disengaged from said second engaging portion upon actuation of said copy initiating means;

a second cam means including a length setting member having a switch actuating portion and a switch electrically connected to said cutting means and engagable by said switch actuating portion, whereby the copying paper can be cut to a length corresponding to the position of said length setting member on said second cam means;

means interlocking said first and second cam means and including a first portion engagable in said first engaging portion for preventing rotation of said first cam means and further including a further locking portion engaging said second cam means for preventing said second cam means from being rotated and being disengaged from said second cam means when said first portion is engaged with said first engaging portion; and said first cam means further having paper feed initiating means coupled to said feeding means for energizing said feeding clutch for feeding the copying paper at the start of rotation of said first cam means;

whereby said first cam means starts its rotation upon operation of said copy initiating means by the disengagement of the locking portion from the second engaging portion in substantial synchronism with the feeding of the copying paper, the first portion of said interlocking means subsequently engages said first engaging portion for stopping rotation of said first cam means and disengages said further locking portion from said second cam means for initiating rotation of said second cam means, and thereafter the switch actuating portion of said length setting member actuates said switch for energizing said cutting means to cut the copying paper.

4. A control means as claimed in claim 3 wherein said paper feed initiating means includes a cam member coaxial with said first cam means and having a switch actuating portion thereon and a further switch connected to said feeding means and actuated upon rotation of said cam member for energizing said feeding clutch.

5. A control means as claimed in claim 3 further comprising a repeat mechanism coupled to said control means for repeatedly operating said copy initiating means for a predetermined number of times preset in said repeat mechanism.

6. In an electrophotographic copying apparatus including a support onto which an original to be copied is placed, an optical system having an illuminating means for projecting an image of the original, a feeding means for feeding a copying paper from a roll of paper along a predetermined path, said feeding means being operatively associated with a feeding clutch, and cutting means disposed along said path for cutting the copying paper; a control means which comprises:

a first cam having first and second engaging portions;

a second cam including a length setting member adjustable to a plurality of positions for cutting the copying paper into a plurality of different lengths, said length setting member having an actuating portion thereon, and a switch electrically connected to said cutting means and actuatable by said actuating portion for cutting the copying paper in a length corresponding to the position of said length setting member;

a manually actuated copy initiating means having an arm member normally engaging said second engaging portion for preventing said first cam from being rotated;

means interlocking said first and second cams and including first and second lever members, the first lever member having a first locking portion engagable with said first engaging portion for temporarily stopping the rotation of said first cam and said second lever member having a second locking portion normally preventing said second cam from being rotated and being freed from said second cam upon engagement of said first lever member with said first engaging portion; and a third cam rotatable with said first cam and having a third engaging portion, a paper feed initiating switch electrically connected to said feeding clutch for feeding the copying paper and actuated by said third engaging portion;

whereby said first cam starts its rotation upon operation of said copy initiating means by the disengagement of the arm member from said second engaging portion in substantial synchronism with the rotation of said third cam, said second cam subsequently initiating its rotation upon engagement of said first engaging portion by the first lever member, whereby said switch is actuated by said actuating portion so that the copying paper is cut into a length substantially corresponding to the length fed during the rotation of said first cam from its start of rotation until the engagement of said first locking portion with said first engaging portion plus the length fed during the rotation of said second cam from its start of rotation until the actuation of said switch by said actuating portion.

7. A control means as claimed in claim 6, further comprising a fourth cam having a fourth engaging portion and a scanning clutch switch actuated by said fourth engaging portion, and a scanning clutch connected to said support and to which said scanning clutch switch is connected.

8. A control means as claimed in claim 6 wherein said length setting member further has an additional actuating portion for engaging said first lever for releasing the engagement of said first locking portion and said first engaging portion so as to permit further roation of said first cam.

9. A control means as claimed in claim 6 further comprising a repeat mechanism coupled to said control means for repeatedly operating said copy initiating means for a predetermined number of times preset in said repeat mechanism.

* * * * *